United States Patent [19]

Croudace et al.

[11] Patent Number: 4,743,273

[45] Date of Patent: May 10, 1988

[54] FUEL COMPOSITION AND METHOD FOR CONTROL OF ENGINE OCTANE REQUIREMENTS

[75] Inventors: Michael C. Croudace, Huntington Beach; Timothy Wusz, Anaheim; Stephen Brass, Fullerton, all of Calif.

[73] Assignee: Union Oil Company of California, Los Angeles, Calif.

[21] Appl. No.: 897,015

[22] Filed: Aug. 15, 1986

[51] Int. Cl.[4] ..... C10L 1/18; C10L 1/22

[52] U.S. Cl. ..... 44/71; 44/77; 44/78; 123/1 A

[58] Field of Search ..... 44/71, 77; 123/1 A

[56] References Cited

U.S. PATENT DOCUMENTS

| | | | |
|---|---|---|---|
| 2,100,287 | 11/1937 | Conquest | 44/77 |
| 2,176,747 | 10/1939 | Schneider et al. | 44/77 |
| 2,210,942 | 8/1940 | Lipkin | 44/77 |
| 2,225,942 | 12/1940 | Schneider et al. | 44/77 |
| 2,706,677 | 4/1955 | Duncan et al. | 44/71 |
| 2,918,359 | 12/1959 | Louett et al. | 44/71 |
| 3,756,794 | 9/1973 | Ford | 44/71 |
| 3,778,372 | 12/1973 | Murphy | 44/71 |
| 4,217,111 | 8/1980 | Frost, Jr. | 44/71 |
| 4,270,930 | 6/1981 | Campbell et al. | 44/71 |
| 4,428,754 | 1/1984 | Smith | 44/71 |
| 4,444,565 | 4/1984 | Croudace | 44/68 |

*Primary Examiner*—William R. Dixon, Jr.
*Assistant Examiner*—E. McAvoy
*Attorney, Agent, or Firm*—Dean Sandford; Gregory F. Wirzbicki; June M. Bostich

[57] ABSTRACT

The octane requirement increase phenomenon in a spark ignition internal combustion engine is controlled by introducing with the combustion charge a fuel composition containing an octane requirement increase-inhibiting amount of a combination of compounds, the combination comprising (1) a gasoline soluble amide and (2) a gasoline soluble ketone. Usually the two compounds are each added to the fuel in a concentration between about 0.001 and 3 weight percent of the fuel. In particular, the combination of N,N-dibutyl formamide and either benzophenone or methylcyclohexanone provides an effective octane requirement increase-inhibiting additive for unleaded gasoline.

84 Claims, No Drawings

FUEL COMPOSITION AND METHOD FOR CONTROL OF ENGINE OCTANE REQUIREMENTS

BACKGROUND OF THE INVENTION

This invention relates to improved hydrocarbon fuels which control the octane requirement increase (ORI) phenomenon observed during the initial portion of the operating life of spark ignition internal combustion engines.

The octane requirement increase (ORI) effect exhibited by internal combustion engines, e.g., spark ignition engines, is well known in the art. This effect may be described as the tendency for an initially new or clean engine to require higher octane quality fuel as operating time accumulates and is coincidental with the formation of deposits in the region of the combustion chamber of the engine. Thus, during the initial operation of a new or clean engine, a gradual increase in octane requirement (OR), the fuel octane number required for knock-free operation, is observed, accompanied by an increasing build-up of combustion chamber deposits until a rather stable or equilibrium OR level is reached. At the equilibrium OR level the accumulation of deposits on the combustion chamber surfaces no longer increases, but remains relatively constant. This so-called "equilibrium value" is usually reached between about 3,000 and 20,000 miles or the corresponding hours of operation. The actual equilibrium value of this increase can vary with engine design and even with individual engines of the same design; however, in almost all cases the increase appears to be significant. ORI values ranging from about 2 to 14 Research Octane Numbers (RON) are commonly observed in modern engines.

It is known that additives may prevent or reduce deposit formation, or remove or modify formed deposits, in the combustion chamber and adjacent surfaces and hence decrease OR. Such additives are generally known as octane requirement reduction (ORR) additives.

For example, in U.S. Pat. No. 4,264,335 to Bello et al., the cerous or ceric salt of 2-ethylhexanoate is disclosed as a useful additive for suppressing the octane requirement increase of a gasoline fired internal combustion engine. It is noted in this patent that the above salt has no effect on combustion efficiency of a gasoline and does not provide anti-knock properties.

In U.S. Pat. No. 4,357,148 to Graiff an additive is disclosed for controlling or reversing the octane requirement increase of a spark ignition internal combustion engine which comprises a combination of (a) certain oil-soluble aliphatic polyamines and (b) certain low molecular weight polymers and/or copolymers of monoolefins having up to 6 carbon atoms.

U.S. Pat. No. 3,506,416 to Patinkin et al. discloses an additive to inhibit octane requirement increase of a spark ignition engine which comprises a gasoline soluble metal salt of a hydroxamic acid. This additive is disclosed as useful in leaded gasolines. Nickel and cobalt are especially preferred as the additives. In U.S. Pat. No. 4,444,565 to Croudace, on the other hand, an oil-soluble iron compound in combination with a carboxylic acid or ester is added to the combustion intake charge of an internal combustion engine to suppress the octane requirement increase. And U.S. Pat. No. 4,217,111 to Frost, Jr., discloses a fuel composition containing gasoline and an octane requirement moderating additive comprising a dialkyl formamide of 7 to 11 carbon atoms.

Other references describing additives for inhibiting octane requirement increase include U.S. Pat. Nos. 3,144,311 and 3,146,203, which disclose utilization of nitrogen ring compounds in combination with an organo metallic primary anti-knock agent and a minor amount of an ignition control additive selected from the group consisting of phosphoric and boron compounds. And U.S. Pat. No. 3,817,721 discloses the use of high molecular weight alkyl aromatic hydrocarbons, or mixtures thereof, for reducing intake valve deposits formed in a spark ignition gasoline-fueled internal combustion engine.

In addition to the foregoing, another known additive for inhibiting ORI is polyaminopolyether carbamate, marketed commercially as Techron, by Chevron Oil Company, and described more fully in U.S. Pat. No. 4,270,930 to Campbell et al. Techron is the industry standard for ORI inhibition, but improvements beyond those afforded by Techron are still being sought. In particular, additives are needed which provide either more inhibition of ORI in engines and/or more reduction in engine OR from their "equilibrium values." More particularly still, an additive is needed which will provide such inhibition or reduction at relatively low concentrations in gasoline.

SUMMARY OF THE INVENTION

It has now been found that a significant reduction in ORI is produced when a minor amount is dissolved in gasoline of an additive comprising a combination of compounds, said combination comprising (1) a gasoline soluble amide, preferably selected from the group consisting of acetamides and formamides having the formula

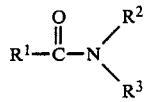

wherein $R^1$ is hydrogen or a methyl group and $R^2$ and $R^3$ are gasoline solubilizing organic radicals having a total between them of between 2 and 20 carbon atoms and (2) a gasoline soluble ketone, preferably selected from the group consisting of unsubstituted and alkyl and polyalkyl substituted cycloalkanones and aromatic ketones.

In engines in which the "equilibrium value" of octane requirement has been reached, the octane requirement of the engine can be reduced from the "equilibrium value" by use of a fuel containing the amide-ketone additives of this invention. Alternatively, for those engines which have not yet reached their equilibrium OR value, the fuels of the present invention are effective in reducing the OR value and/or inhibiting any further increase in the OR value.

Accordingly, the invention provides a method for operating a spark ignition internal combustion engine which comprises introducing with the combustion intake charge to the engine an octane requirement increase-inhibiting or octane requirement reducing amount of a combination of compounds comprising a gasoline soluble amide and a gasoline soluble ketone.

The invention further provides a motor fuel composition comprising a mixture of hydrocarbons boiling in the gasoline range, usually from about 25° C. (77° F.) to about 225° C. (437° F.), containing an octane requirement increase-inhibiting amount of an additive comprising the above combination of an amide and a ketone.

Further provided according to the invention is an octane requirement increase-inhibiting additive concentrate comprising (a) from about 1 to about 500 grams per gallon of the above described combination of an amide and a ketone and (b) the balance consisting essentially of a fuel-compatible diluent boiling in the range from about 25° C. (77° F.) to about 225° C. (437° F.).

DETAILED DESCRIPTION OF THE INVENTION

The combination of compounds herein can be added with success to either leaded or unleaded gasolines, such as those used in automobiles having catalytic converters, but unleaded gasolines are preferred. An unleaded gasoline as herein defined is a gasoline containing less than 0.05 grams of lead per gallon (0.0132 gm/l).

In the practice of this invention octane requirement increase caused by combustion of gasolines in a spark ignition internal combustion engine is suppressed or reversed by introducing with the combustion charge a fuel composition containing a combination of (1) at least one gasoline soluble amide compound, preferably selected from the group consisting of acetamides and formamides of the formula

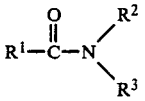

wherein $R^1$ is hydrogen or a methyl group and $R^2$ and $R^3$ are gasoline solubilizing radicals, said radicals having a total of between 2 and 20 carbon atoms, and $R^2$ and $R^3$ optionally but not preferably containing an inorganic species bonded to a carbon atom and (2) at least one gasoline soluble ketone compound preferably selected from the group consisting of gasoline soluble unsubstituted and alkyl and polyalkyl substituted cycloalkanones and aromatic ketones.

The typical amide and ketone compounds used in the invention are themselves well known. As stated above, $R^2$ and $R^3$ of the preferred amide are gasoline-solubilizing organic radicals, totalling 2 to 20 carbon atoms, such as substituted or unsubstituted alkyl, aryl, arylalkyl, alkyloxy, aryloxy, arylalkyloxy, alkenyl, alkenyloxy, alkynyl, alkynyloxy, and arylalkenyl radicals and heteroatom-substituted hydrocarbyl radicals wherein the heteroatoms are selected from the group consisting of oxygen, sulfur, and nitrogen atoms. Preferably, however, the gasoline-solubilizing radicals are unsubstituted alkyl radicals, and more preferably still, unsubstituted alkyl radicals of 2 to 5 carbon atoms.

Examples of amide compounds suitable for use in this invention are N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N- heptyl formamide, N,N-dipentyl formamide, N-propyl-N-octyl formamide, N-methyl-N-propyl acetamide, N-propyl-N-butyl acetamide, N-ethyl-N-decyl acetamide, N,N-dibutyl acetamide, N,N-dipropyl acetamide; N-nonyl-N-decyl acetamide, and the like. As will be seen by those skilled in the art, the foregoing compounds contain a normal alkyl group for $R^2$ and $R^3$ of the above formula. However, these groups could also be branched-chain radicals such as isopropyl, isobutyl, tertiary butyl, isoamyl, etc. But the most preferred amide compound is N,N-dibutyl formamide.

Examples of the preferred gasoline soluble ketone compounds for use in the invention are the unsubstituted and alkyl or polyalkyl substituted cycloalkanones (such as pentanones) and aromatic ketones (such as phenones) having a total of between 1 and 25 carbon atoms in the substituents thereto. Examples of the preferred ketone compounds for use in this invention are methylcyclohexanone, ethyl-methyl benzophenone, propyl-butyl benzophenone, dimethyl benzophenone, cyclopentanone, trimethyl benzophenone, ethyl-methyl cyclopentanone, propyl-butyl cyclopentanone, dibutyl cyclopentanone, and the like. The most preferred ketones for use herein are methylcyclohexanone and benzophenone. Although not a preferred embodiment, the gasoline soluble ketones can also contain one or more inorganic species.

Thus, in the most preferred embodiment the combination of compounds contemplated herein comprises N,N-dibutyl formamide as the amide compound and methylcyclohexanone or benzophenone as the ketone.

The concentration of each of the compounds comprising the combination additive provided in fuels according to this invention is usually between about 0.001 and 3.0 weight percent, making a total combinative additive concentration between about 0.002 and 6.0 weight percent. At a level lower than about 0.002 weight percent in fuel, the desired inhibition of the octane requirement increase usually is not observed. The upper level for the concentration of the combination additive is usually selected to balance the cost of the combination additive with a decreasing efficiency for reducing the octane requirement increase. In the preferred embodiment, when the combination of an amide and cycloalkanone is used, the concentration of both the amide and the cycloalkanone in the fuel is between about 0.05 and 1.0 weight percent. However, when the combination comprises an amide and aromatic ketone, the preferred concentration of the amide is between 0.05 and 1.0 weight percent and the preferred concentration of the aromatic ketone in the fuel is between about 0.05 and 0.5 weight percent. Higher concentrations, of course, can be used, but it has been found that using a concentration of benzophenone greater than about 0.5 weight percent can result in a build up of deposits in the engine rather than a reduction in octane requirement. Whether this result is characteristic of all aromatic ketones, or benzophenone specifically, has not as yet been determined.

Suitable liquid hydrocarbon fuels of the gasoline boiling range as described in ASTM D-439 are mixtures of hydrocarbons boiling in the range from about 25° C. (77° F.) to about 225° C. (437° F.), and often comprise mixtures of saturated hydrocarbons, olefinic hydrocarbons and aromatic hydrocarbons. Preferred are gasoline blends consisting of or consisting essentially of a saturated hydrocarbon content ranging from about 40 to about 80 percent by volume, an olefinic hydrocarbon content from about 0 to about 30 percent by volume and an aromatic hydrocarbon content ranging from about 10 to about 60 percent by volume. The base fuel can be derived from straight run gasoline, polymer gasoline, natural gasoline, dimer and trimerized olefins, synthetically-produced hydrocarbon mixtures, from thermally or catalytically reformed hydrocarbons, or from catalytically cracked or thermally cracked petroleum stocks, and mixtures of these. The hydrocarbon composition and octane level of the base fuel are not critical. Any conventional motor fuel base may be employed in the practice of this invention.

Normally, the hydrocarbon fuel mixtures to which the invention is applied may contain minor amounts of blending agents such as methanol, ethanol, methyl tert butyl ether, and the like. The fuels may also contain antioxidants such as phenolics, e.g., 2,6-di-tert-butylphenol or phenylenediamines, metal deactivators, antiknock compounds such as tetraethyl lead, a methyl cyclopenta dienyl manganese tricarbonyl, ortho-azidophenol and the like. However, the preferred fuels are unleaded fuels and thus contain no added tetraethyl lead.

The octane requirement reduction additive of the present invention can be introduced into the combustion zone of the engine in a variety of ways to prevent buildup of deposits, or to accomplish reduction or modification of deposits. Thus the ORR additive can be injected into the intake manifold intermittently or substantially continuously, preferably in a hydrocarbon carrier having a final boiling point (by ASTM D86) lower than about 225° C. (437° F.). A preferred method is to dissolve the additive in the fuel, either by blending the additive separately into the fuel or with other fuel additives.

The invention further provides a concentrate for use in liquid hydrocarbon fuel in the gasoline boiling range comprising (a) from about 1 to 500 grams per gallon of the hereinabove described oil-soluble, amide-ketone combination, (b) optionally from about 0.01 to 0.2 weight percent of a dehazer and (c) the balance consisting essentially of a diluent, boiling in the range from about 25° C. (77° F.) to about 225° C. (437° F.). Typical diluents include hydrocarbons and oxygen-containing hydrocarbons. Suitable oxygen-containing hydrocarbon diluents include, e.g., methanol, ethanol, propanol, methyl tert-butyl ether and ethylene glycol monobutyl ether. The hydrocarbon diluent may be an alkane such as heptane but preferably is an aromatic hydrocarbon, such as toluene or xylene, alone or in admixture with said oxygen-containing hydrocarbon diluents. The optional dehazer is usually a polyester-type ethoxylated alkylphenolformaldehyde resin, but is not specifically limited thereto.

The following examples demonstrate the surprising suppression of octane requirement increase when utilizing an additive comprising the amide-ketone combination in a fuel for a spark ignited internal combustion engine. These examples are meant to be illustrative of the instant invention and not intended to limit the scope of the appended claims.

EXAMPLE 1

An initially clean 1973 350 CID V8 Chevrolet engine is utilized to compare the additive of the instant invention for the inhibition of octane requirement increase with Techron, a polyaminopolyether carbamate manufactured by Chevron Oil Company. The additives are added to the gasoline described in Table 1.

TABLE 1

| GASOLINE FUEL CHARACTERISTICS | |
|---|---|
| Characteristic | |
| Gravity @ 60° F. (15.6° C.) °API | 55.9 |
| Research Octane No. | 94.4 |
| Motor Octane No. | 84.6 |
| Reid Vapor Pressure, | |
| psi | 8.7 |
| atm | 1.6 |
| FIA (D 1319) wt % | |
| Aromatics | 33.0 |
| Olefins | 6.5 |
| Saturates | 60.5 |
| Distillation (D 86) °F. (°C.) | |
| Initial | 96 (35.6) |
| 10% | 125 (51.7) |
| 30% | 184 (84.4) |
| 50% | 225 (107.2) |
| 70% | 266 (130.0) |
| 90% | 334 (167.8) |
| 95% | 360 (182.2) |
| End Point | 420 (215.6) |
| Sulfur (ppm) | 250 |
| % Carbon | 86.5 |

As a carburetor cleanliness additive, oleylamine is added in a concentration of 14 pounds per thousand barrels.

The test consists of two parts, a deposit accumulation phase and a rating phase. During the deposit accumulation phase of the test, the engine is run on the cycle described in Table 2. It is noted that, during this test, the water temperature out of the engine was 185° F. (85° C.) and the oil sump temperature was between 200° and 250° F. (93° and 121° C.).

TABLE 2

| | Time | | Speed | | Load |
|---|---|---|---|---|---|
| Step | min | RPM | MPH | (km/hr) | BHP* |
| 1 | 2 | 700 | idle | | 3 |
| 2 | 3 | 1700 | 45 | (72) | 15 |
| 3 | 4 | 1200 | 35 | (56) | 7 |
| 4 | 0.1 | 2225 | 60 | (97) | 100 |
| 5 | 3 | 2400 | 65 | (105) | 60 |

This cycle corresponds to an average speed of about 40 miles per hour, 64 km/hr.

*BHP = brake horsepower.

During the rating phase of the test, in which the engine's octane requirement is rated, the engine is run under disc control. The disc contains a recording of the intake manifold vacuum and engine speed of a car being accelerated according to the Coordinating Research Council (CRC) Octane Requirement Procedure. 1983 CRC reference fuels are used during the rating phase to determine the octane requirement of the engine. The reference fuels utilized in this test include a primary reference fuel (PRF), a full boiling range unleaded fuel (FBRU) and a full boiling range sensitive unleaded fuel (FBRSU).

To test an additive, the engine is run on the standard gasoline described in Table 1 until a stabilized or equilibrium octane requirement of the clean engine is obtained. During deposit build-up, octane requirements are evaluated after 2, 24 and 100 hours of operation and every 100 hours thereafter until the requirement of the engine stops increasing, i.e., equilibrium has been reached. A typical ORI test lasts from 400 to 600 hours. Operation for about 500 hours is equivalent to about 20,000 miles (32,189 km).

Upon the engine reaching an equilibrated octane requirement, the engine is switched to fuel containing the additive, run for 6 hours on the deposit accumulation cycle summarized in Table 2, and rerated for octane requirement. A comparison of the ratings before and after the engine is run on additive-containing fuel determines the effectiveness of the additive.

To show the effectiveness of the amine-ketone combination for the reduction of octane requirement, two separate combinations herein, one using equal parts of N,N dibutyl formamide and methylcyclohexanone and one using equal parts of N,N-dibutyl formamide and benzophenone, are compared with Techron, a known ORR agent. The first set of four tests, Examples 1 to 4, compares 0.05 weight percent concentrations of each compound in the combination with 0.5 weight percent concentrations of Techron. The second set of tests, Examples 5 and 6, use concentrations of 0.5 weight percent of each of the compounds in the combination. Results of the tests are summarized in Table 3.

TABLE 3

Difference in Octane Requirement After a Six-Hour Slug Treatment

| Ex. No. | Compound Tested (Wt. % added to Fuel) | Change in Octane Requirement PRF | FBRU | FBRSU |
|---|---|---|---|---|
| 1 | Benzophenone (0.05) and N,N—dibutyl foramide (0.05) | −1 | −1 | −1 |
| 2 | Methylcyclohexanone (0.05) and N,N—dibutyl foramide (0.05) | −1 | −1 | −1 |
| 3 | Techron or OGA 273 (0.5) | −1 | −1 | −1 |
| 4 | Techron or OGA 273 (0.5) | −1 | −1 | −1 |
| 6 | Methylcyclohexanone (0.5) and N,N—dibutyl formamide (0.5) | −1 | −1 | −1 |
| 6 | Benzophenone (0.5) and N,N—dibutyl formamide (0.5) | 0 | 0 | 0 |
| 7 | N,N—dibutyl formamide (0.5) | +2 | +2 | +2 |
| 8 | Methylcyclohexanone (0.5) | +1 | +2 | +2 |

The results show that combinations of N,N-dibutyl formamide and benzophenone and of methylcyclohexanone and N,N-dibutylformamide, when used in a concentration of 0.05 weight percent for each compound in the combination, achieve the same reduction in octane requirement as a 0.5 weight percent concentration of Techron, reduction of one Research Octane Number, in 6 hours of operation for each of the three CRC standard fuels used, PRF, FBRU and FBRSU. Therefore these combinations are equally effective for reducing the octane requirements of an equilibrium engine as Techron, the current industry standard. However, as is illustrated by examples 5 and 6, when each of the additives is employed in the combination in a concentration of 0.5 weight percent, only the combination of methylcyclohexanone and N,N-dibutyl formamide is effective for reducing the octane requirement. The use of 0.5 weight percent of benzophenone in combination with the same concentration of the amide results in no decrease in octane requirement, while at 0.5 weight percent the same combination proves effective for reducing the octane requirement. (Whether the result at 0.5 weight percent is specific to benzophenone or is characteristic of aromatic ketones in general due to their known tendency to act as precursors to engine deposits is presently undetermined.) On the other hand, as is shown by examples 7 and 8, neither N,N-dibutyl formamide nor methylcyclohexanone used alone in a concentration of 0.5 weight percent is effective for reducing octane requirement. Instead, the octane requirement of the engine increases by as much as two octane numbers when the compounds preferred for use in the combination are used alone at 5 times the total concentration of the combination used in Example 1.

EXAMPLE 2

An initially clean Oldsmobile Omega engine powered by a 2.5 liter 4-cylinder engine is utilized to compare the additive of the instant invention for the inhibition of octane requirement increase with Techron, the above described commercially available additive. The additives are added to the gasoline described in Table 1. The deposit accumulation phase and the rating phase employ the same set of conditions described in Table 2 except that when the engine reaches a stabilized octane requirement after being run using the fuel of Table 1, the fuel is switched to that containing the additive herein, the engine is run for 24 hours on fuel containing the additive, and then is rerated. A comparison of the ratings before and after the engine is run on additive-containing fuel determines the effectiveness of the additive.

Results of the tests, Examples 9 to 13, for ratings utilizing PRF, FBRU and FBRSU fuels are summarized in Table 4. Examples 9 and 10 employ Techron at a concentration of 0.5 weight percent. Examples 11 to 13 utilize an additive combination containing 0.25 weight percent of methylcyclohexanone and 0.25 weight percent of N,N-dibutylformamide. As shown by the data in Table 4, the additive combination of the invention equalled and eight times outperformed Techron, the industry standard, for each of the standard test fuels employed.

TABLE 4

Decrease in Octane Requirement After a 24-Hour Slug Treatment

| Ex. No. | Compound(s) Tested (Concentration Wt. %) | Change in Octane Requirement PRF | FBRU | FBRSU |
|---|---|---|---|---|
| 9 | Techron (0.5) | −.5 | −1.0 | −1.0 |
| 10 | Techron (0.5) | −1.0 | −1.5 | −1.5 |
| 11 | Methylcyclohexanone (0.25) and N,N—dibutyl formamide (0.25) | −1.0 | −2.0 | −2.0 |
| 12 | Methylcyclohexanone (0.25) and N,N—dibutyl formamide (0.25) | −1.5 | −2.0 | −2.0 |
| 13 | Methylcyclohexanone (0.25) and N,N—dibutyl formamide (0.25) | −3.5 | −3.0 | −3.0 |

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the claims.

We claim:

1. A fuel composition comprising a hydrocarbon liquid boiling within the gasoline range having dissolved therein an octane requirement increase-inhibiting amount of a combination of compounds comprising (1) a gasoline soluble ketone selected from the group consisting of cycloalkanones and aromatic ketones and (2) a gasoline-soluble amide selected from the group consisting of formamides and acetamides having the formula

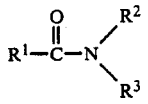

wherein $R^1$ is hydrogen or methyl radical, and $R^2$ and $R^3$ are gasoline solubilizing organic radicals, said gasoline solubilizing radicals containing between them a total of between 2 and 20 carbon atoms.

2. The composition of claim 1 wherein the ketone is a cycloalkanone and the amide and cycloalkanone are each present in a concentration of between about 0.001 and about 3.0 weight percent of the fuel.

3. The composition of claim 1 wherein the ketone is an aromatic ketone, the concentration of the amide being between about 0.001 and about 3.0 and the concentration of the aromatic ketone being between about 0.001 and 0.5 weight percent of the fuel.

4. The composition of claim 1 wherein $R^2$ and $R^3$ are selected from the group consisting of substituted and unsubstituted alkyl, aryl, arylalkyl, alkyloxy, aryloxy, arylalkyloxy, alkenyl, alkenyloxy, alkynyl, alkynloxy, and arylalkenyl radicals and heteroatom-substituted hydrocarbyl radicals wherein the heteroatoms are selected from the group consisting of oxygen, sulfur, and nitrogen atoms.

5. The composition of claim 1 wherein $R^2$ and $R^3$ are straight or branched chain alkyl radicals.

6. The composition of claim 2 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide and N-ethyl-N-decyl acetamide.

7. The composition of claim 2 wherein the ketone is selected from the group consisting of unsubstituted and alkyl and polyalkyl substituted cycloalkanones having a total of between 1 and 25 carbon atoms in the alkyl and polyalkyl substitutents.

8. The composition of claim 6 wherein the ketone is selected from the group consisting of unsubstituted and alkyl and polyalkyl substituted cycloalkanones having a total of between 1 and 25 carbon atoms in the alkyl and polyalkyl substituents.

9. The composition of claim 1 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propylbutyl cyclopentanone, and dibutyl cyclopentanone.

10. The composition of claim 1 wherein the concentration of the combination added is between about 0.002 and 6.0 weight percent.

11. The composition of claim 1 wherein the fuel composition is unleaded and the concentration of the amide and ketone each is between about 0.05 and 1.0 weight percent in the fuel.

12. A method for operating a spark ignition engine which comprises introducing a combustion intake charge to the engine comprising the composition of claim 1.

13. The composition of claim 1 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide, and N-ethyl-N-decyl acetamide.

14. The composition of claim 3 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide, and N-ethyl-N-decyl acetamide.

15. The composition of claim 9 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide, and N-ethyl-N-decyl acetamide.

16. The composition of claim 7 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide, and N-ethyl-N-decyl acetamide.

17. The composition of claim 13 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propyl cyclopentanone, and dibutyl cyclopentanone.

18. The composition of claim 4 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propyl cyclopentanone, and dibutyl cyclopentanone.

19. The composition of claim 5 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propyl cyclopentanone, and dibutyl cyclopentanone.

20. The composition as defined in claim 1 wherein the ketone is selected from the group consisting of phenones and unsubstituted and alkyl and dialkyl substituted pentanones.

21. The composition as defined in claim 13 wherein the ketone is selected from the group consisting of phenones and unsubstituted and alkyl and dialkyl substituted pentanones.

22. The composition as defined in claim 4 wherein the ketone is selected from the group consisting of phenones and unsubstituted and alkyl and dialkyl substituted pentanones.

23. The composition as defined in claim 5 wherein the ketone is selected from the group consisting of phenones and unsubstituted and alkyl and dialkyl substituted pentanones.

24. The composition as defined in claim 1 wherein said ketone is benzophenone and said amide is N,N-dibutyl formamide.

25. The composition as defined in claim 11 wherein said ketone is benzophenone and said amide is N,N-dibutyl formamide.

26. The composition as defined in claim 1 wherein said ketone is methylcyclohexanone and said amide is N,N-dibutyl formamide.

27. The composition as defined in claim 11 wherein said ketone is methylcyclohexanone and said amide is N,N-dibutyl formamide.

28. The composition as defined in claim 13 wherein the concentration of the combination added is between about 0.002 and 6.0 weight percent.

29. The composition as defined in claim 17 wherein the concentration of the combination added is between about 0.002 and 6.0 weight percent.

30. The composition as defined in claim 21 wherein the concentration of the combination added is between about 0.002 and 6.0 weight percent.

31. The composition as defined in claim 4 wherein the concentration of the combination added is between about 0.002 and 6.0 weight percent.

32. A composition as defined in claim 1 wherein the ketone is selected from the group consisting of unsubstituted and alkyl and polyalkyl substituted cycloalkanones having a total of between 1 and 25 carbon atoms in the alkyl and polyalkyl substituents.

33. A composition as defined in claim 4 wherein the ketone is selected from the group consisting of unsubstituted and alkyl and polyalkyl substituted cycloalkanones having a total of between 1 and 25 carbon atoms in the alkyl and polyalkyl substituents.

34. A composition as defined in claim 31 wherein the ketone is selected from the group consisting of unsubstituted and alkyl and polyalkyl substituted cycloalkanones having a total of between 1 and 25 carbon atoms in the alkyl and polyalkyl substituents.

35. The composition as defined in claim 1 wherein said ketone is an aromatic ketone.

36. The composition as defined in claim 4 wherein said ketone is an aromatic ketone.

37. The composition as defined in claim 13 wherein said ketone is an aromatic ketone.

38. The composition as defined in claim 1 wherein said ketone is a cycloalkanone.

39. The composition as defined in claim 4 wherein said ketone is a cycloalkanone.

40. The composition as defined in claim 13 wherein said ketone is a cycloalkanone.

41. The fuel composition of claim 25 wherein said fuel is unleaded gasoline.

42. The fuel composition of claim 27 wherein said fuel is unleaded gasoline.

43. The fuel composition of claim 1 wherein said fuel is unleaded gasoline.

44. The fuel composition of claim 36 wherein said fuel is unleaded gasoline.

45. The fuel composition of claim 33 wherein said fuel is unleaded gasoline.

46. The fuel composition of claim 17 wherein said fuel is unleaded gasoline.

47. The fuel composition of claim 29 wherein said fuel is unleaded gasoline.

48. A fuel composition comprising hydrocarbons of the gasoline boiling range having dissolved therein in a total combined concentration of at least 0.002 percent by weight a gasoline soluble amide and a gasoline soluble ketone, said ketone being selected from the group consisting of cycloalkanones and aromatic ketones and the amide being selected from the group consisting of acetamides and formamides having the formula

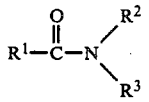

wherein $R^1$ is hydrogen or methyl radical, and $R^2$ and $R^3$ are gasoline solubilizing organic radicals, said gasoline solubilizing radicals containing between them a total of between 2 and 20 carbon atoms.

49. A fuel composition as defined in claim 14 wherein said amide and said ketone each are present in a concentration between about 0.001 and 3 weight percent of the composition.

50. The composition of claim 48 wherein the concentration of the amide and the ketone is each between about 0.05 and 1.0 weight percent of the composition.

51. The composition of claim 49 wherein $R^2$ and $R^3$ are independently selected from the group consisting of substituted or unsubstituted alkyl, aryl, arylalkyl, alkyloxy, aryloxy, arylalkyloxy, alkenyl, alkenyloxy, alkynyl, alkynyloxy, and arylalkenyl radicals and heteroatom-substituted hydrocarbyl radicals wherein the heteroatoms are selected from the group consisting of oxygen, sulfur, and nitrogen atoms.

52. The composition of claim 48 wherein the ketone is selected from the group consisting of unsubstituted and alkyl and polyalkyl substituted cycloalkanones and aromatic ketones.

53. The composition of claim 52 wherein $R^2$ and $R^3$ are independently selected from the group consisting of substituted or unsubstituted alkyl, aryl, arylalkyl, alkyloxy, aryloxy, arylalkyloxy, alkenyl, alkenyloxy, alkynyl, alkynyloxy, and arylalkenyl radicals and heteroatom-substituted hydrocarbyl radicals wherein the heteroatoms are selected from the group consisting of oxygen, sulfur, and nitrogen atoms.

54. The composition of claim 52 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide and N-ethyl-N-decyl acetamide.

55. A method for operating a spark ignition engine which comprises introducing with the combustion intake charge to the engine the composition of claim 48.

56. A fuel composition as defined in claim 48 wherein said ketone is an aromatic ketone.

57. The composition of claim 49 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide, and N-ethyl-N-decyl acetamide.

58. The composition of claim 49 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propyl cyclopentanone, and dibutyl cyclopentanone.

59. The composition of claim 51 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propyl cyclopentanone, and dibutyl cyclopentanone.

60. The composition of claim 57 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propyl cyclopentanone, and dibutyl cyclopentanone.

61. The composition as defined in claim 51 wherein the ketone is selected from the group consisting of phenones and unsubstituted and alkyl and dialkyl substituted pentanones.

62. The composition as defined in claim 57 wherein the ketone is selected from the group consisting of phenones and unsubstituted and alkyl and dialkyl substituted pentanones.

63. The composition as defined in claim 49 wherein said ketone is benzophenone and said amide is N,N-dibutyl formamide.

64. The composition as defined in claim 49 wherein said ketone is methylcyclohexanone and said amide is N,N-dibutyl formamide.

65. A composition as defined in claim 51 wherein the ketone is selected from the group consisting of unsubstituted and alkyl and polyalkyl substituted cycloalkanones having a total of between 1 and 25 carbon atoms in the alkyl and polyalkyl substituents.

66. The fuel composition of claim 48 wherein said fuel is unleaded gasoline.

67. The fuel composition of claim 60 wherein said fuel is unleaded gasoline.

68. A concentrate suitable for use in liquid hydrocarbon fuel in the gasoline boiling range comprising:

(a) a combination additive comprising (1) a gasoline soluble amide selected from the group consisting of formamides and acetamides having the formula

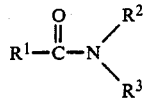

wherein $R^1$ is hydrogen or methyl radical, and $R^2$ and $R^3$ are gasoline solubilizing organic radicals, said gasoline solubilizing radicals containing between them a total of between 2 and 20 carbon atoms, and (2) a gasoline soluble ketone selected from the group consisting of cycloalkanones and aromatic ketones, said combination additive being present in a concentration between about 1 and 500 grams per gallon of concentrate, and (b) a fuel compatible diluent boiling in the range of from about 25° C. (77° F.). to about 225° C. (437° F.).

69. The concentrate of claim 68 wherein the amide is selected from the group consisting of formamides and acetamides having the formula

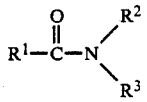

wherein $R^1$ is hydrogen or a methyl radical and $R^2$ and $R^3$ are gasoline solubilizing organic radicals, each gasoline solubilizing radical having between 1 and 10 carbon atoms, and the ketone is selected from the group consisting of unsubstituted and alkyl and polyalkyl substituted cyclicalkanones and aromatic ketones having a total of between 1 and 25 carbon atoms in the alkyl and polyalkyl substituents.

70. The concentrate of claim 68 wherein the gasoline solubilizing radicals are selected from the group consisting of substituted and unsubstituted alkyl, aryl, arylalkyl, alkyloxy, and arylakenyl radicals and hetero-atom-substituted hydrocarbyl radicals wherein the heteroatoms are selected from the group consisting of oxygen, sulfur, and nitrogen atoms.

71. The concentrate of claim 68 wherein the ketone is selected from the group consisting of unsubstituted and alkyl and dialkyl substituted pentanones and phenones.

72. The concentrate of claim 68 wherein the diluent is selected from the group consisting of hydrocarbons, oxygenated hydrocarbons, and mixtures thereof.

73. The concentrate of claim 68 wherein the hydrocarbon fuel is an aromatic hydrocarbon.

74. The concentrate of claim 68 wherein the ketone is a phenone.

75. The concentrate of claim 68 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide, and N-ethyl-N-decyl acetamide.

76. The concentrate of claim 71 wherein the amide is selected from the group consisting of N-methyl-N-hexyl formamide, N,N-dibutyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N,N-dipentyl formamide, N-propyl-N-octyl formamide, N-methyl-N-propyl acetamide, N-propyl-N-butyl acetamide, N,N-dibutyl acetamide, N,N-dipropyl acetamide, N-nonyl-N-decyl acetamide, and N-ethyl-N-decyl acetamide.

77. The concentrate of claim 69 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propyl cyclopentanone, and dibutyl cyclopentanone.

78. The concentrate of claim 75 wherein the ketone is selected from the group consisting of methylcyclohexanone, ethylmethyl benzophenone, propylbutyl benzophenone, dimethyl benzophenone, cyclopentanone, trimethyl benzophenone, ethylmethyl cyclopentanone, propyl cyclopentanone, and dibutyl cyclopentanone.

79. The concentrate as defined in claim 68 wherein said ketone is benzophenone and said amide is N,N-dibutyl formamide.

80. The concentrate as defined in claim 68 wherein said ketone is methylcyclohexanone and said amide is N,N-dibutyl formamide.

81. A concentrate as defined in claim 70 wherein the ketone is selected from the group consisting of unsubstituted and alkyl and polyalkyl substituted cycloalkanones having a total of between 1 and 25 carbon atoms in the alkyl and polyalkyl substituents.

82. A concentrate as defined in claim 75 wherein the ketone is selected from the group consisting of unsubstituted and alkyl and polyalkyl substituted cycloalkanones having a total of between 1 and 25 carbon atoms in the alkyl and polyalkyl substituents.

83. The concentrate as defined in claim 68 wherein said ketone is an aromatic ketone.

84. The concentrate as defined in claim 68 wherein said ketone is a cycloalkanone.

* * * * *

UNITED STATES PATENT AND TRADEMARK OFFICE

CERTIFICATE OF CORRECTION

PATENT NO. : 4,743,273

DATED : May 10, 1988

INVENTOR(S) : Michael C. Croudace, Timothy Wusz, and Stephen G. Brass

It is certified that error appears in the above-identified patent and that said Letters Patent is hereby corrected as shown below:

In column 12, line 36, change "14" to --48--".

Signed and Sealed this

Eleventh Day of October, 1988

*Attest:*

DONALD J. QUIGG

*Attesting Officer*

*Commissioner of Patents and Trademarks*